United States Patent [19]

Greenberg et al.

[11] Patent Number: 4,927,082

[45] Date of Patent: May 22, 1990

[54] BALL-TYPE WATER SPRINKLER

[75] Inventors: Ilan Greenberg, Haifa; Amir Cohen, Yuvalium, both of Israel

[73] Assignee: Lego M. Lemelshtrich Ltd., Netanya, Israel

[21] Appl. No.: 393,732

[22] Filed: Aug. 15, 1989

[30] Foreign Application Priority Data

Apr. 19, 1989 [IL] Israel ..... 90037

[51] Int. Cl.[5] ..... B05B 3/06

[52] U.S. Cl. ..... 239/230; 239/242; 239/381

[58] Field of Search ..... 239/230, 240, 241, 242, 239/380, 381, DIG. 1

[56] References Cited

U.S. PATENT DOCUMENTS

| | | | |
|---|---|---|---|
| 1,864,892 | 6/1932 | Coles et al. | 239/242 |
| 2,009,478 | 7/1935 | Coles et al. | 239/230 |
| 2,942,789 | 6/1960 | Smith | 239/242 |
| 3,526,363 | 9/1970 | Hauser | 239/230 |
| 3,567,122 | 3/1971 | Congdon et al. | 239/242 |
| 3,602,431 | 8/1971 | Lockwood | 239/206 |
| 3,771,723 | 11/1973 | Ray | 239/230 |
| 3,785,565 | 1/1974 | Perry et al. | 239/242 |
| 3,874,588 | 4/1975 | Flynn | 239/230 |
| 4,253,608 | 3/1981 | Hunter | 239/242 |
| 4,625,914 | 12/1986 | Sexton et al. | 239/242 |

*Primary Examiner*—Andres Kashnikow
*Assistant Examiner*—Michael J. Forman
*Attorney, Agent, or Firm*—Benjamin J. Barish

[57] ABSTRACT

A ball-type water sprinkler of the sector type includes two inlets into the ball chamber oriented to direct the water to flow in opposite directions circumferentially around the chamber, and a shutter rotatable with the rotor and movable either to a first position with respect to the rotor covering one inlet and uncovering the other inlet to cause the water to flow in a first direction, or to a second position uncovering the one inlet and covering the other inlet to cause the water to flow in the opposite direction. The shutter is actuated by a member rotatable with the rotor and cooperable with the sector stops of the sprinkler, the actuator being coupled to the shutter by an over-center spring coupling producing a snap action movement of the shutter to either its first or second positions.

19 Claims, 2 Drawing Sheets

FIG 2
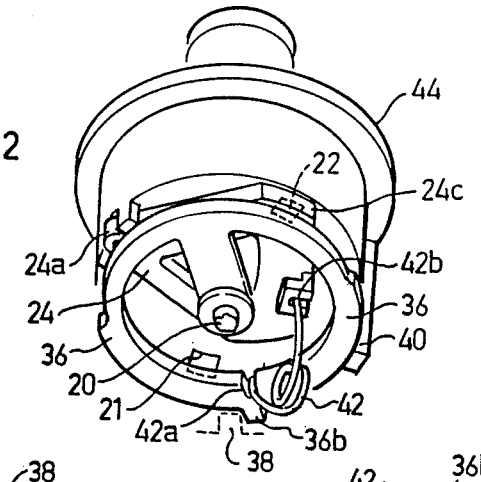
FIG 3a
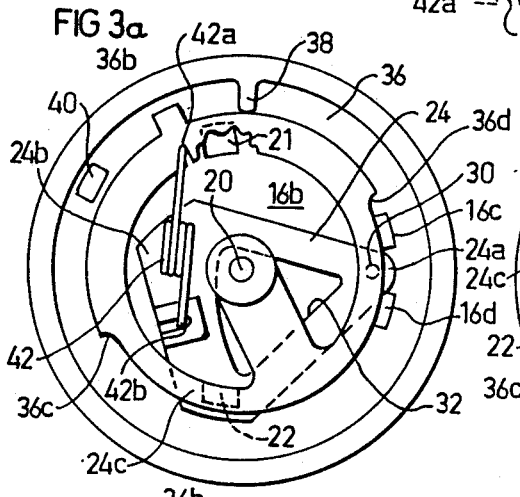
FIG 3b
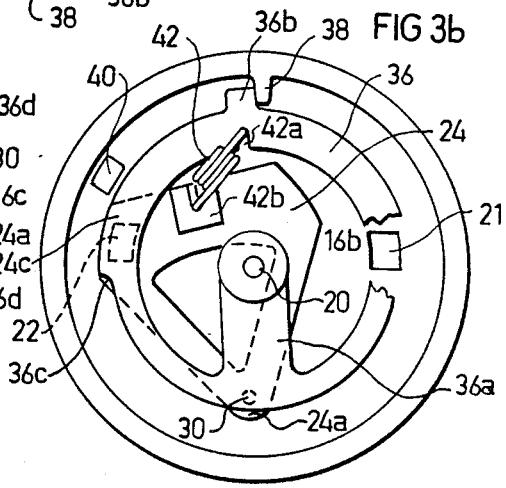
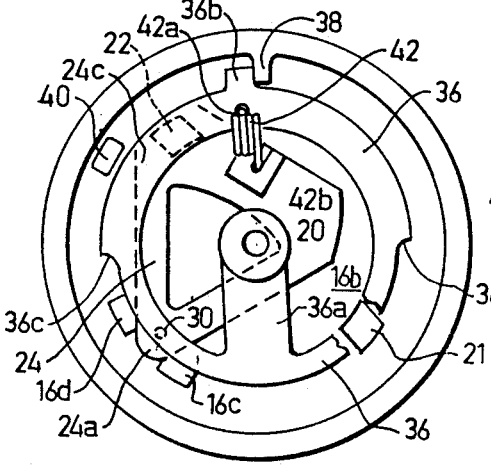
FIG 3c
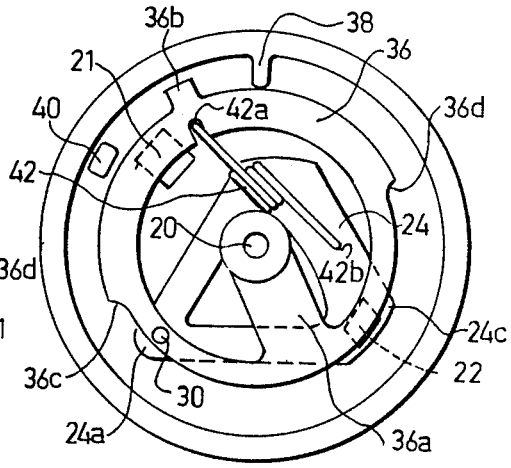
FIG 3d

BALL-TYPE WATER SPRINKLER

BACKGROUND OF THE INVENTION

The present invention relates to water sprinklers, and particularly to the ball-type water sprinkler.

The conventional ball-type water sprinkler comprises a housing, a rotor mounted for rotation within the housing and including a chamber having a water inlet oriented to direct the water to flow circumferentially of the chamber, a ball freely movable within the chamber according to the direction of flow of the water therein, an impact element fixed to the rotor to be impacted by the ball and to rotate the rotor according to the direction of rotation of the ball therein, an outlet from the chamber, and a nozzle communicating with the outlet and rotatable with the rotor. Such a ball-type water sprinkler rotates continuously in one direction, and therefore distributes the water in a full-circle around the sprinkler.

There are many applications wherein it is desired to distribute the water only in a preselected sector rather than in a full-circle around the sprinkler. Examples of the prior known sector sprinklers of this type are shown in U.S. Pat. Nos. 3,526,363, 3,930,618, 4,625,914, 4,781,328, 4,784,325 and 4,787,558. However, the known sprinklers of this type are generally of relatively complicated structure which is expensive to produce and maintain.

OBJECTS AND SUMMARY OF THE INVENTION

An object of the present invention is to provide a ball-type water sprinkler which can be used for distributing the water only in a preselected sector. Another object of the invention is to provide a sprinkler of the foregoing type which is of simple construction which can be manufactured and assembled in volume and at low cost.

According to the present invention, there is provided a ball-type water sprinkler as described above characterized in that: the housing includes a fixed stop and a presettable stop presettable about the circumference of the housing; the rotor includes two inlets oriented to direct the water to flow in opposite directions circumferentially around the chamber; and the sprinkler further includes a shutter rotatable with the rotor and movably mounted with respect thereto to a first position covering one inlet and uncovering the other inlet to cause the water to flow in a first direction, or to a second position uncovering the one inlet and covering the other inlet to cause the water to flow in the opposite direction; an actuator member rotatable with the rotor and having a projection engageable with the fixed stop or the presettable stop during its rotation; and a coupling between the actuator member and the shutter and effective to move the shutter to its first position wherein the projection engages the fixed stop, or to a second position wherein the projection engages the presettable stop.

According to further features in the described preferred embodiment, the coupling between the actuator member and the shutter is an over-center spring coupling producing a snap action movement of the shutter to either its first or second position. Also, the two inlets are disposed on opposite sides of the rotor, and the shutter is pivotally mounted about a pivot point on the rotor between the two inlets. Preferably, the shutter is of generally triangular configuration and is pivotally mounted at one apex, covers one inlet with a second apex in the first position of the shutter, and covers the other inlet with the third apex in the second position of the shutter. In the described embodiment, the shutter is formed with a central slot whose edges are engageable with an abutment element carried centrally of the rotor to define the two positions of the rotor.

According to still further features in the described preferred embodiment, both the rotor and the actuator member have a circular outer configuration of the same diameter, the projection of the actuator member projecting radially outwardly of the actuator member and rotor. More particularly, the actuator member is formed with a radially-extending arm pivotally mounted at the rotary axis of the rotor, on the inlet side thereof. In addition, the outer surface of the actuator member is formed with shoulders engageable with shoulders formed on the rotor to define the two positions of the actuator member with respect to the rotor.

The foregoing features enable ball-type water sprinklers to be constructed in volume and at low cost and having the capability of being preset to distribute water only to selected sector areas.

Further features and advantages of the invention will be apparent from the description below.

BRIEF DESCRIPTION OF THE DRAWINGS

The invention is herein described, by way of example only, with reference to the accompanying drawings, wherein:

FIG. 2 is a three-dimensional view illustrating the rotor assembly in the water sprinkler of FIG. 1; and FIGS. 3*a*–3*d* are bottom views of the rotor assembly of FIG. 2 but illustrating its various conditions during a 180° rotation of the water sprinkler.

DESCRIPTION OF PREFERRED EMBODIMENTS

Figure 1:
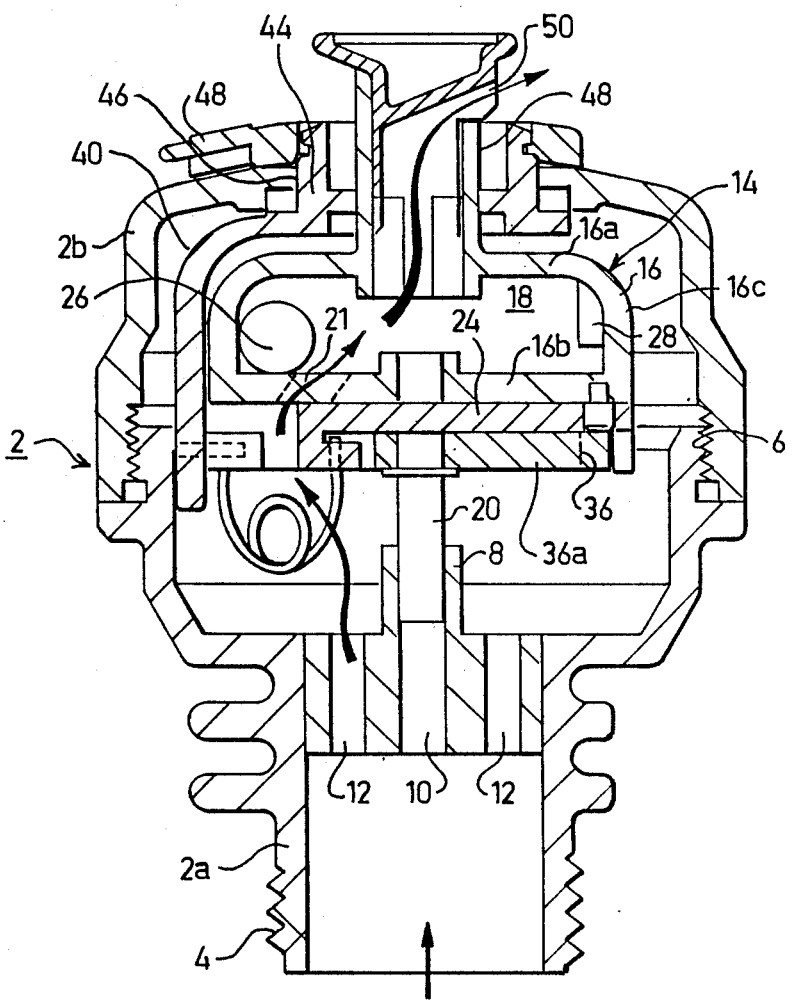
FIG. 1 is a longitudinal sectional view illustrating one form of water sprinkler constructed in accordance with the present invention.

The water sprinkler illustrated in the drawings comprises a housing, generally designated 2, including a lower section 2*a* formed with external threads 4 for securing the sprinkler to a vertical riser, and an upper section 2*b* formed with threads 6 for securing it to the lower housing section 2*a*. The lower housing section 2*a* is integrally formed with a central stem 8 having an axial bore 10, and with a plurality of openings 12 arranged in a circular array around bore 10 for inletting the water into the sprinkler housing.

Rotatably mounted within housing 2 is a rotor assembly, generally designated 14. Rotor assembly 14 includes a rotor 16 of generally cylindrical configuration and having a top wall 16*a*, a bottom wall 16*b*, and a cylindrical side wall 16*c*, defining an internal chamber 18. Rotor 16 is rotatably mounted to stem 8 of the housing by a pin 20 received within bore 10 of the housing stem 8.

The bottom wall 16*b* of rotor 16 is formed with two water inlet openings 21, 22 (the latter inlet opening being seen in FIGS. 3*a*–3*d*). Each of the two inlets openings 21, 22 is located adjacent to the outer side of the rotor bottom wall 16*b* and extends tangentially to the outer side so as to impart a rotary or swirling motion to the water entering chamber 18. Inlet opening 21 is oriented in one direction tangentially to the rotor bottom wall 16*b*, whereas inlet opening 22 is oriented in the opposite direction, such that if the water enters chamber 18 via inlet 21 the water flows circumferentially through the chamber in one direction, whereas if the water enters via inlet 22, it flows circumferentially in the opposite direction.

The direction of flow of the water through chamber 18 is controlled by a shutter 24 which is selectively positionable to open one or the other of the two inlets 21, 22, and thereby to control the direction of flow of the water through chamber 18. For example, FIG. 3*a* illustrates shutter 24 as uncovering inlet 21 and covering inlet 22, so that the water will enter chamber 18 via inlet 21, whereupon the water will flow in the clockwise direction through the chamber because of the tangential orientation of inlet 21.

Rotor assembly 14 further includes a ball 26 freely movable within chamber 18 so as to be rotated in that chamber according to the direction of the flow of the water, as determined by which of the two inlets 21, 22 is opened by shutter 24. Side wall 16*c* of rotor 16 is formed with an impact element 28 which is impacted by ball 26 during its rotation within chamber 18, thereby rotating rotor 16, and the complete rotor assembly 14, around bore 10 of the housing 2. The direction of rotation of rotor assembly 14 depends on which of the two inlets 21, 22 is uncovered by shutter 24.

As shown particulary in FIGS. 3*a*–3*d*, shutter 24 is of generally triangular configuration. It is pivotally mounted at apex 24*a* of its three apices 24*a*–24*c* to rotor 16 by a pivot pin 30. Shutter 24 may assume two stable positions, namely one position (FIG. 3*a*) wherein its second apex 24*b* uncovers inlet 21 and its third apex 24*c* covers inlet 22, or a second stable position (FIG. 3*d*) wherein its apex 24*b* covers inlet 21 and its apex 24*c* uncovers inlet 22. The shutter is further formed with a central slot 32 of generally triangular configuration whose sides are engageable by pin 20 of the rotor assembly 14 to define the above two stable positions of the shutter.

Rotor assembly 14 further includes an actuator member 36 having a circular outer configuration of the same diameter as the outer surface of side wall 16*c* of rotor 16 and rotatable with the rotor during the rotation of the rotor assembly 14 about pin 20. Actuator member 36 is formed with a radially- extending arm 36*a* rotatably mounted to pin 20 so that the actuator member may also rotate with respect to the rotor 16. A shoulder 36*b* projects radially outwardly from the outer surface of the actuator member and is engageable with either a stop 38 fixed to the inner face of housing 2, or a stop 40 presettable to any desired position according to the desired sector of water distribution by the sprinkler.

Actuator member 36 is coupled to shutter 24 by an over-center spring 42, having one end 42*a* secured to the actuator member, and the opposite end 42*b* secured to the shutter. As will be described more particularly below, when projection 36*b* of the actuator member engages the fixed stop 38 of the housing during the rotation of rotor 16, the rotation of the actuator member 36 is arrested, whereas the rotor continues to rotate a slight distance. This causes actuator member 36 to change its angular position with respect to rotor 16 and shutter 24, until the over-center spring 42 moves the shutter 24 with a snap-action from one of its stable states to its other stable state. This movement of the shutter closes the previously-open inlet (21 or 22) and opens the previously-closed inlet, thereby reversing the flow of the water through chamber 18, and the direction of rotation of the rotor assembly 14.

The outer surface of actuator member 36 is further formed with two shoulders 36*c*, 36*d*, cooperable with shoulders 16*c*, 16*d* in rotor 16 and straddling the opposite sides of pivot pin 30 of shutter 24. These shoulders prevent continued rotation of the actuator member in one direction.

As shown particularly in FIGS. 1 and 2, presettable stop 40 is in the form of an arm extending along the outer face of rotor 16 and its actuator member 36 so as to be engageable by projection 36*b* of the actuator member. Stop 40 is fixed to a disc 44 rotatably mounted within an opening 46 in housing 2. Disc 44 includes an externally-extending fingerpiece 48 enabling the position of stop 40 to be preset according to the desired sector of water distribution.

Rotor 16 is further fomred with an outlet pipe 48 communicating with chamber 18 and passing through opening 46 of the housing 2. The outer end of the outlet pipe 48 terminates in a nozzle 50 for discharging the water in the form of a jet.

The overall operation of the illustrated water sprinkler will now be described with particular reference to FIGS. 3*a*–3*d*.

First, the user preselects the sector of water distribution desired by grasping fingerpiece 48 and rotating it, to thereby preset stop 40 with respect to the fixed stop 38 on the inner face of housing 2. The sector angle of water distribution is determined by the angle between the housing fixed stop 38 and the presettable stop 40. Both the housing and the fingerpiece 48 may be provided with suitable markings to indicate this sector angle.

Assuming the parts of the water sprinkler are in the condition illustrated in FIG. 3*a*, the water will enter chamber 18 via inlet 21, which is uncovered by shutter 24, rather than via inlet 22 which is covered by the shutter. Inlet 21 is oriented in the tangential direction so as to impart a clockwise movement of the water entering chamber 18. This clockwise movement of the water drives ball 26 in the same clockwise direction, causing the ball to impact element 28 of rotor 16, thereby imparting a clockwise rotation to the rotor. This clockwise rotation of the rotor also rotates the actuator member 26 with it, until projection 36*b* of the actuator member 36 engages the fixed stop 38 fixed to housing 2. This is the condition illustrated in FIG. 3*b*.

As ball 26 further impacts element 28, the rotor 16 will rotate in the same clockwise direction, but the actuator member 36 will be prevented from rotating with the rotor by the engagement of projection 36*b* with the stop 38 fixed to housing 2. Accordingly the over-center spring coupling 42 between the actuator member 36, and the shutter 24 (which shutter is rotating with the rotor 16), will be stressed (as shown in FIG. 3*c*), until end 42*a* of the spring 42 fixed to the actuator member 36 passes the axis of the spring, when this occurs, the spring pivots shutter 24 with a snap-action about pivot point 30, to the position illustrated in FIG. 3*d*. In this position of the shutter, apex 24*b* of the shutter now closes inlet 21, whereas apex 24*c* of the shutter uncovers inlet 22.

Accordingly, the water will now enter chamber 18 via inlet 22 which, as noted above, is oriented to impart a rotational flow of the water in the opposite direction, i.e., counter-clockwise. Ball 26 will now be driven in the counter-clockwise direction, such that its impacts against impact element 28 will rotate rotor 16, as well as the shutter 24 and actuator member 36, in the counter-clockwise direction. This movement continues until projection **36*b* of the actuator member engages the presettable stop 40 and causes the over-center spring 42 to move shutter 24 with a snap-action back to its original condition wherein its apex 24*b* uncovers inlet 21 and its apex 24*c* covers inlet 22. The water is thereby caused to flow in the original clockwise direction through chamber 18 and to rotate the rotor assembly 14** in the clockwise direction.

The water is discharged from chamber 18 of rotor 16 via the outlet pipe 48 and nozzle 50, both secured to rotate with the rotor, so that the discharge from the nozzle 50 will be according to the sector of oscillation of the rotor 16.

While the invention has been described with respect to one preferred embodiment, it will be appreciated that many variations may be made. For example, the invention could be advantageously incorporated in pop-up sprinklers, namely sprinklers having nozzles or water discharge heads which are normally disposed in a retracted position when not in use, but which pop-up under water pressure during use. Many other variations, modifications and applications of the invention will be apparent.

What is claimed is:

1. A ball-type water sprinkler, comprising a housing; a rotor mounted for rotation within the housing and including a chamber having a water inlet oriented to direct the water to flow circumferentially of the chamber; a ball freely movable within the chamber according to the direction of flow of the water therein; an impact element fixed to the rotor to be impacted by the ball and to rotate the rotor according to the direction of rotation of the ball therein; a water outlet from said chamber; and a nozzle communicating with the outlet and rotatable with the rotor; characterized in that:

said housing includes a fixed stop and a presettable stop presettable about the circumference of the housing;

said rotor includes two inlets oriented to direct the water to flow in opposite directions circumferentially around said chamber;

and said sprinkler further includes a shutter rotatable with the rotor and movably mounted with respect thereto to a first position covering one inlet and uncovering the other inlet to cause the water to flow in a first direction, or to a second position uncovering said one inlet and covering said other inlet to cause the water to flow in the opposite direction; an actuator member rotatable with the rotor and having a projection engageable with the fixed stop or the presettable stop during its rotation; and a coupling between the actuator member and the shutter and effective to move the shutter to its first position wherein said projection engages said fixed stop, or to its second position wherein said projection engages said presettable stop.

2. The sprinkler according to claim 1, wherein said coupling between the actuator member and the shutter is an over-center spring coupling producing a snap action movement of the shutter to either its first or second positions.

3. The sprinkler according to claim 1, wherein said two inlets are disposed on opposite sides of said rotor, and said shutter is pivotally mounted about a pivot point on the rotor between said two inlets.

4. The sprinkler according to claim 3, wherein said shutter is of generally triangular configuration and is pivotally mounted at one apex, covers one inlet with a second apex in said first position of the shutter, and covers the other inlet with the third apex in said second position of the shutter.

5. The sprinkler according to claim 4, wherein said shutter is formed with a central slot whose edges are engageable with an abutment element carried centrally of the rotor to define the two positions of the rotor.

6. The sprinkler according to claim 5, wherein said actuator member is pivotally mounted to the rotor about said abutment element engageable with the edges of the slot of said shutter.

7. The sprinkler according to claim 1, wherein both said rotor and said actuator member have a circular outer configuration of the same diameter, said projection of the actuator member projecting radially outwardly of the actuator member and rotor.

8. The sprinkler according to claim 7, wherein said actuator member is formed with a radiallyextending arm pivotally mounted at the rotary axis of the rotor on the inlet side thereof.

9. The sprinkler according to claim 8 wherein the outer surface of the actuator member is formed with shoulders engageable with shoulders formed on the rotor to define the two positions of the actuator member with respect to the rotor.

10. The sprinkler according to claim 1, wherein said presettable stop is in the form of an arm secured to a disc rotatably mounted between the housing and the rotor coaxially to the axis of rotation of the rotor, said arm depending from said disc and extending along the outer face of the rotor and actuator member so a to be engageable by the projection of the actuator member.

11. A ball-type water sprinkler, comprising:

a housing;

a rotor mounted for rotation within the housing and including a chamber having two water inlets oriented to direct the water to flow in opposite directions circumferentially around the chamber;

a ball freely movable within the chamber according to the direction of flow of the water therein;

an impact element fixed to the rotor to be impacted by the ball and to rotate the rotor according to the direction of rotation of the ball therein;

a water outlet from said chamber;

and a nozzle communicating with the outlet and rotatable with the rotor;

said housing including a pair of stops at least of which is presettable about the circumference of the housing;

said sprinkler further including: a shutter rotatable with the rotor and movably mounted with respect thereto to a first position covering one inlet and uncovering the other inlet to cause the water to flow in a first direction, or to a second position uncovering said one inlet and covering said other inlet to cause the water to flow in the opposite direction; an actuator member rotatable with the rotor and having a projection engageable with one of the stops during its rotation; and a coupling between the actuator member and the shutter and effective to move the shutter to its first position wherein said projection engages said one of said stops, or to its second position wherein said projection engages the other of said stops;

said coupling between the actuator member and the shutter being an over-center spring coupling producing a snap action movement of the shutter to either its first or second positions.

12. The sprinkler according to claim 11, wherein said two inlets are disposed on opposite sides of said rotor, and said shutter is pivotally mounted about a pivot point on the rotor between said two inlets.

13. The sprinkler according to claim 12, wherein said shutter is of generally triangular configuration and is pivotally mounted at one apex, covers one inlet with a second apex in said first position of the shutter, and covers the other inlet with the third apex in said second position of the shutter.

14. The sprinkler according to claim 13, wherein said shutter is formed with a central slot whose edges are engageable with an abutment element carried centrally of the rotor to define the two positions of the rotor.

15. The sprinkler according to claim 14, wherein said actuator member is pivotally mounted to the rotor about said abutment element engageable with the edges of the slot of said shutter.

16. The sprinkler according to claim 11, wherein both said rotor and said actuator member have a circular outer configuration of the same diameter, said projection of the actuator member projecting radially outwardly of the actuator member and rotor.

17. The sprinkler according to claim 16, wherein said actuator member is formed with a radially-extending arm pivotally mounted at the rotary axis of the rotor on the inlet side thereof.

18. The sprinkler according to claim 17, wherein the outer surface of the actuator member is formed with shoulders engageable with shoulders formed on the rotor to define the two positions of the actuator member with respect to the rotor.

19. The sprinkler according to claim 11, wherein said presettable stop is in the form of an arm secured to a disc rotatably mounted between the housing and the rotor coaxially to the axis of rotation of the rotor, said arm depending from said disc and extending along the outer face of the rotor and actuator member so as to be engageable by the projection of the actuator member.

* * * * *